United States Patent [19]

Nordlund

[11] 4,354,424

[45] Oct. 19, 1982

[54] PNEUMATIC OPERATING DEVICE

[75] Inventor: Sven Nordlund, Vällingby, Sweden

[73] Assignee: Wire Matic Regler AB, Stockholm, Sweden

[21] Appl. No.: 202,382

[22] PCT Filed: Nov. 21, 1979

[86] PCT No.: PCT/SE79/00240

§ 371 Date: Jul. 24, 1980

§ 102(e) Date: Jul. 2, 1980

[87] PCT Pub. No.: WO80/01096

PCT Pub. Date: May 29, 1980

[30] Foreign Application Priority Data

Nov. 24, 1978 [SE] Sweden ..... 7812136

[51] Int. Cl.[3] ..... F01B 7/02; F01B 31/10; F01B 9/00

[52] U.S. Cl. ..... 92/69 R; 92/130 D; 92/136; 92/155

[58] Field of Search ..... 92/130 D, 136, 155, 92/130 A, 69 R, 75, 130 R

[56] References Cited

U.S. PATENT DOCUMENTS

| | | | |
|---|---|---|---|
| 941,999 | 11/1909 | Lewis | 92/130 D |
| 1,031,323 | 7/1912 | Christensen | 92/130 D |
| 2,053,720 | 9/1936 | Huck | 92/130 D |
| 2,817,562 | 12/1957 | Fleming et al. | 92/155 |
| 3,054,136 | 9/1962 | Schlage et al. | 92/136 |
| 4,087,074 | 5/1978 | Massey | 92/130 A |

*Primary Examiner*—Paul E. Maslousky

*Attorney, Agent, or Firm*—Sughrue, Mion, Zinn, Macpeak & Seas

[57] ABSTRACT

A pneumatic operating device, e.g. for controlling valves, includes a cylinder (2) in which a piston (12) is movable. The piston has an axially extending rack part (11) having teeth which engage with teeth on an operating element (10) arranged in the cylinder wall (2*b*) for rotation transversely of the longitudinal axis of the piston and passing sealingly through said cylinder wall. The piston (12) is provided on the side opposite its rack part with a recess (24) for receiving a part of a spring (26) for the return movement of the piston. The recess (24) extends substantially into the rack part (11) of the piston, preferably through a distance of such length that it extends axially approximately up to or beyond a radial line perpendicular to the piston axis through the center of rotation of the operating element even when the piston is in a position in which the spring is compressed to its maximum. The cylinder of the operating device may have separate end walls (4) which are removably connected to the cylinder by means of screws (7). One of the end walls (4) has arranged therein an opening (15) for connection to an air-supply line. The cylinder wall (2) has an axially extending bore (18) and the end wall (4) a bore (17) which extends at right angles to said bore (21), said bores together forming an air-supply passage leading to the interior of the cylinder. A substantial part of the peripheral surface of the pistons rack part (11) which abuts and guides against the inner wall of the cylinder (2) is coated with polytetrafluoretylene.

10 Claims, 4 Drawing Figures

PNEUMATIC OPERATING DEVICE

The present invention relates to pneumatic operating devices, e.g. devices for regulating valves, of the kind which include a cylinder having a piston arranged for movement therein. The piston has an axially extending rack portion having teeth which engage teeth on an operating element mounted for rotation in at least one cylinder wall transversely of the axial direction of the piston. The piston passes through the cylinder wall and forms a seal therewith. The piston is located on the side of the cylinder wall opposite the rack portion and has a recess for accommodating a part of a return spring for the return movement of the piston.

Different kinds of such operating devices are known to the art, e.g. for opening and closing such valves as ball valves. Examples of such known devices are described in Swedish lay-open-prints 337,746 and 361,712, German Offenlegungsschrifts 2,647,385 and 2,430,268 and French Pat. No. 2,121,444.

With one such known operating device, springs are used for the return stroke of the piston, the springs being short and encircling rod-like elements for guiding the piston during movement thereof. The short springs produce only a small returning force and the return force varies widely over the length of the piston stroke. The arrangement of guide elements for guiding piston movement creates the disadvantage of an increase in the number of elements in the operating device and enhances the risk of the piston sticking in the cylinder.

A particular problem encountered with such operating devices is connected with the fact that their function is often such that the valve or the like operated by the device is held open when the piston is acted upon by air under pressure. When the pressure ceases, the valve is closed by the spring. If, however, the spring exerts only a small force or if the spring force varies in a manner such that only a slight force is exerted on the piston in the final stage of its closing movement, there is a risk that the valve will not be completely closed, which, as will readily be understood, can result in serious consequences.

An object of the present invention is to provide an operating device with which the aforementioned disadvantages are avoided. An operating device according to the invention is mainly characterized in that the recess for accommodating the spring extends a substantial distance into the rack portion of the piston, so that one end of the spring inserted in the recess, even when the piston is in the position in which the spring is compressed to its maximum, extends axially approximately up to or beyond a radial line through the center of rotation of the operating element.

An operating device according to the invention is distinguished by the fact that its operating element delivers a strong force with minor variations during its movement, and is thus more reliable than known operating devices. The spring operating the piston may also be comparatively strongly tensioned in one limit position of the piston, the spring tension being further increased upon movement of the piston as a result of the air pressure acting thereon. Thus, the piston will be returned by the spring in a much more positive and distinct manner than with known operating devices. Among one of the advantages afforded by the invention is that the same operating device can be used to operate larger valves than has hitherto been possible.

Practical tests have shown that with all conditions equal, an operating device according to the invention can use springs which deliver work which is four times greater in kilopound-meters than the operating devices previously known in the art.

The cylinder may in practice have a separate end wall which is removably connected to the cylinder by means of screws. The end wall may have a hole by means of which the cylinder can be connected to an air line. Further, the cylinder wall may have an axial bore which extends at right angles to the end wall and which together with the hole forms an air-supply passage to the cylinder interior.

The outer end wall of the operating device may conveniently be provided on the inside thereof with a separate sealed end wall which defines the cylinder space and which is provided with a groove for accommodating an O-ring.

The function of the operating device can be further improved by coating the peripheral surface of the rack part abutting the inner wall of the cylinder with polytetrafluoretylene.

Exemplary embodiments of the invention will now be described with reference to the accompanying, partially schematic drawings.

Figure 1:
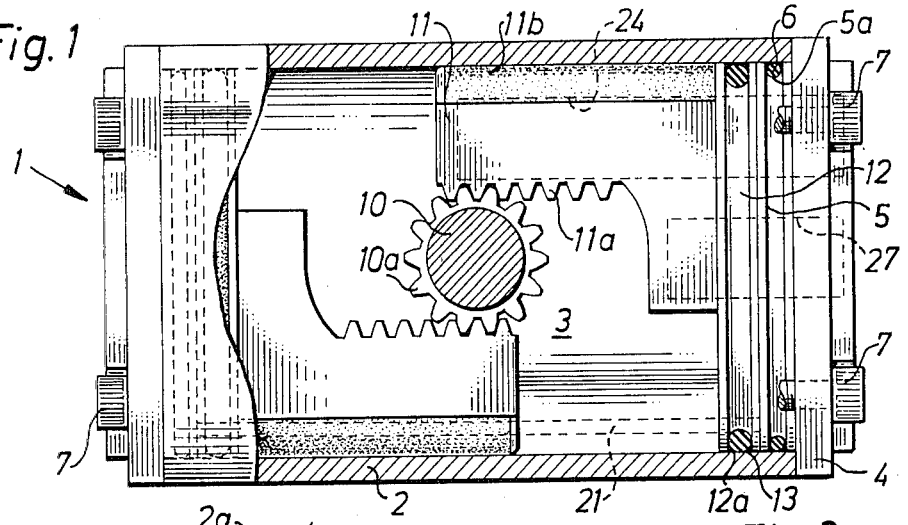
FIG. 1 is a cross-sectional view of an operating device according to the invention.
Figure 2:
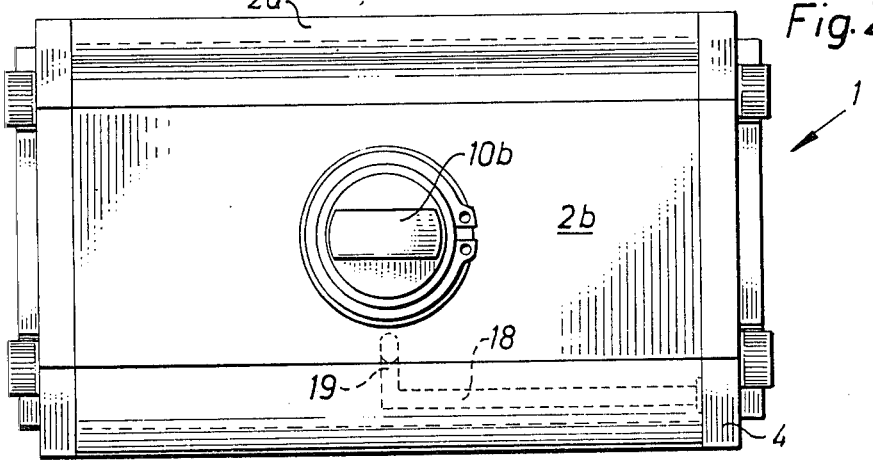
FIG. 2 is a side view of the operating device shown in FIG. 1.
Figure 3:
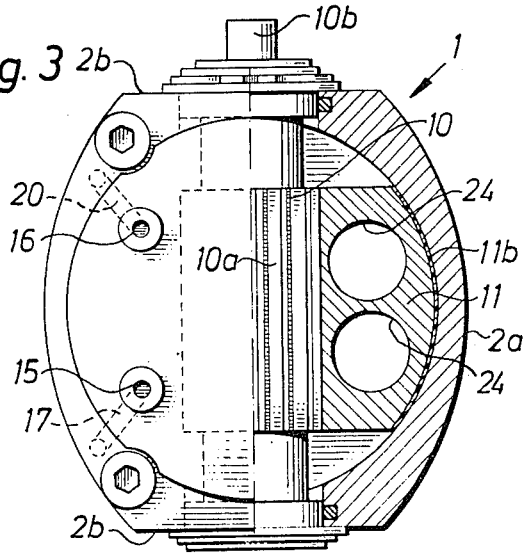
FIG. 3 is a partially cut-away end view of the operating device shown in FIG. 1.

Referring to FIGS. 1–3, a pneumatic operating device 1 comprises a cylinder 2 having two mutually opposite curved side surfaces 2*a* and two mutually opposite flat side surfaces 2*b*. The inner surfaces of the sides 2*a* and 2*b* define together with inner end walls 5 a cylindrical chamber 3. The inner end walls 5 are integral with outer end walls 4, the walls 4 being joined to the cylinder walls 2 by means of screws 7. Arranged in the inner end walls 5 are grooves 5*a* which accommodate a respective 0-ring 6 for sealing the cylinder chamber 3.

Extending through the flat side walls 2*b* of the cylinder is a cylindrical operating element 10 whose axis extends perpendicular to the cylinder axis. The operating element is sealingly mounted in the flat side walls 2*b* and has an external dogging means 10*b* intended, e.g., to actuate a ball valve (not shown). The dogging means may be arranged for rotation through an angle of 90°.

The central part of the operating element 10 is provided with teeth 10*a* which mesh with teeth 11*a* on two axially extending rack parts 11, each of which is connected to separate pistons 12.

Each of the pistons 12 is arranged for movement between two limit positions in the chamber 3. Each piston 12 has a peripheral groove 12*a* for accommodating an O-ring 13.

The pistons are movable between two limit positions defined by the inner end walls 5 and the rack parts 11, namely positions in which the rack parts strike against the opposite inwardly facing surfaces of the pistons.

Arranged in one end wall 4 are two connection openings 15, 16 for air-supply lines (not shown). The opening 15 communicates with the central part of the chamber 3 via a passage 17 in the outer end wall 4, a connecting axial passage 18 and a radial channel 19 in the cylinder wall.

The other opening 16 communicates with the chamber 3 in the region of the two inner end walls 5 via corresponding passages 20, 21.

By supplying air under pressure to one of the holes 15 or 16, the pistons 12 can be caused to move towards and away from each other, thereby rotating the operating element 10.

In addition, the movement of the pistons 11 away from each other may, takes place against the action of a spring force. Referring to the right-hand piston 12 and associated rack part 11 in FIGS. 1 and 3—it can be seen that the pistons are provided with axially extending recesses or bores 24 in which springs are accommodated. These springs are referenced 26 in the embodiment shown in FIG. 4.

Figure 4:
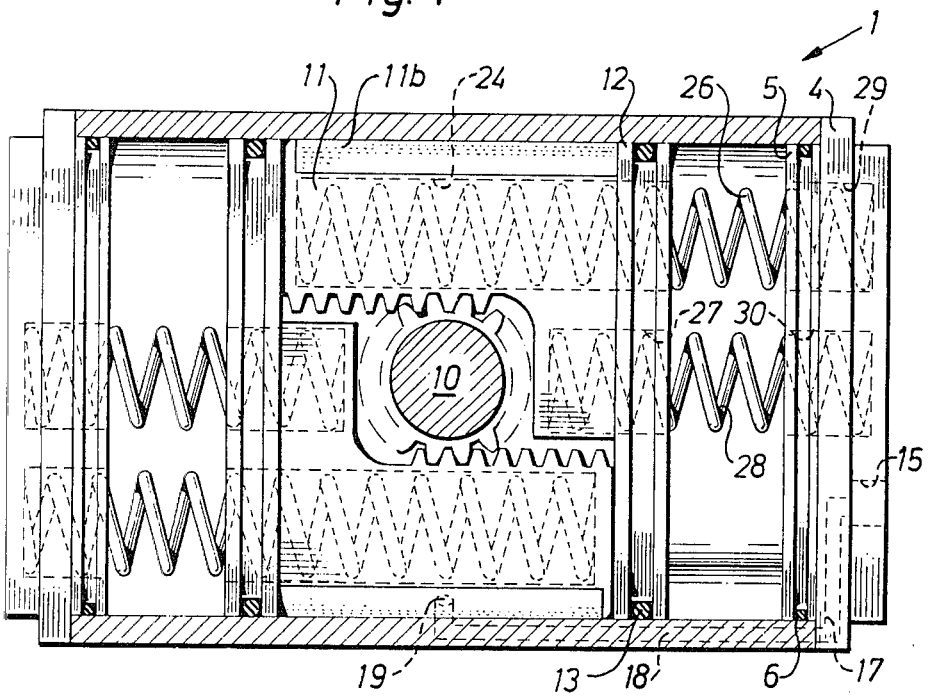
FIG. 4 is a vertical sectional view in larger scale of the principle elements of an operating device shown in FIG. 1, provided with piston-return springs.

As will be seen from FIGS. 1 and 4, the bores 24 extend along substantially the whole length of the rack part 11, which means that the springs 26 will be relatively long.

In the FIG. 3 embodiment, two bores 24 for accommodating springs 26 are arranged adjacent one another.

The pistons 12 are also provided with two central bores 27 for receiving springs 28 of shorter length, as shown in FIG. 4. The springs 26, 28 are also received in recesses 29, 30 in the inner and outer end walls 4, 5.

When the pistons 12 and associated rack parts 11 accommodate springs 26, 28, the pistons will normally only move away from one another under the action of a pneumatic force, the springs causing the pistons to return to their starting positions.

As will be seen from FIG. 1, the bore or recess 24 in the rack part 11 of the piston 12 is of such length that a spring 26 inserted in the recess extends not only up to a radial line perpendicular to the axis of the piston through the pivot center of the operating element 10 but beyond this radial line, even when the piston 29 is in a position in which the springs are compressed to their maximum.

Because the springs 26 are relatively long, the pistons 12 and respective rack parts 11 will execute a uniform and distinct return movement, this movement being transmitted to the operating element 10. The springs may also be substantially pre-stressed in their limit positions, thereby ensuring that the operating element will always rotate to its limit position, which in practice means that a valve operated by the operating device will always be precisely closed.

As will be understood, the central springs 28 shown in FIG. 4 also contribute this positive valve-closing operation, but cannot be given the same pretension as the springs 26 without jeopardizing the correct function of the operating device.

The peripheral surfaces of the rack part 11 abutting and guiding against the inner wall of the cylinder are coated with a layer of polytetrafluoretylene 11*b*, thereby to obtain the least possible friction as the pistons move in the cylinder.

In accordance with a modified embodiment, there is used only one piston and associated rack part for activating the operating element 10. In this embodiment, the cylinder chamber is somewhat shorter than in the other embodiments.

Preferably the pistons and associated rack parts are always provided with elongate bores 24 of the kind described. The same pistons can therewith be used irrespective of whether the operating device is intended for movement in both directions under pneumatic pressure or only in one direction, the return movement of the pistons being obtained by spring pressure. Thus, the same operating device can be used in both cases, it being decided in the actual place of use how the pistons shall be returned.

I claim:

1. A pneumatic operating device (1) for regulating a valve, comprising:

a cylinder (2) having an end wall (5);

a piston (12) slidably mounted in said cylinder, said piston having a bore (24) therein;

an operating element (10) rotatably mounted in a side surface (2*b*) of said cylinder so that an axis of said operating element extends in a direction substantially perpendicular to and intersecting a central longitudinal axis of said cylinder, said operating element extending across said cylinder along said perpendicular direction, said operating element forming a seal with said side surface of said cylinder and having first teeth (10*a*) thereon;

a rack part (11) connected to said piston, said rack part having second teeth (11*a*) thereon engaged with said first teeth, a portion of said rack part extending axially into said cylinder, said portion of said rack part being laterally offset from said central longitudinal axis of said cylinder, said bore in said piston extending into said portion of said rack part a sufficient distance that said bore extends past said operating element axis when said piston is adjacent said end wall of said cylinder; and a spring (26) disposed in said bore for biasing said piston toward said operating element, said spring being compressed when said piston is displaced from said end wall of said cylinder a maximum distance so that said piston is always positively urged toward said operating element by said spring.

2. The operating device claimed in claim 1, wherein a substantial part of a peripheral surface of said rack part (11) abutting an inner wall of the cylinder (2) is coated with polytetrafluorethylene (11*b*).

3. The operating device claimed in claim 1 further comprising means (15–19) for moving said piston toward said end wall of said cylinder and away from said operating element against said biasing force of said spring.

4. The operating device claimed in claim 1 further comprising a second piston and second rack part connected thereto, a second portion of said second rack part extending axially into said cylinder and being laterally offset from said central longitudinal axis of said cylinder, said second piston and said second rack part portion having a second bore therein which extends a sufficient distance into said second rack part so that said second bore extends past said operating element axis when said second piston is adjacent an opposite end wall of said cylinder, and a second spring disposed in said second bore for biasing said second piston toward said operating element when said second piston is adjacent said opposite end wall, said second spring being compressed when said second piston is displaced from said opposite end wall a maximum distance so that said second piston is always positively urged toward said operating element by said second spring.

5. The operating device claimed in claim 1 wherein said operating element is rotatably mounted in opposite side surfaces (2*b*) of said cylinder, said opposite side surfaces of said cylinder being flat and being connected together by curved side surfaces (2*a*), said operating element being sealably mounted in said opposite side surfaces.

6. The operating device claimed in claim 4 further comprising an O-ring, said O-ring being disposed in a peripheral groove (12*a*) of said piston.

7. The operating device claimed in claim 1 wherein said piston is movable between first and second limit positions, said first limit position being reached when said piston contacts said end wall of said cylinder, said second limit position being reached when said rack part portion contacts an opposite end wall of said cylinder, said second teeth on said rack part engaging said first teeth on said operating element causing said operating element to rotate as said piston is moved between said first and second limit positions.

8. The operating device claimed in claim 1 further comprising a second bore located in said piston and said portion of said rack part, said second bore being adjacent said first bore and being laterally offset from said central longitudinal axis of said cylinder, said first and second bores having a length which is substantially the same, and a second spring disposed in said second bore, said second spring being compressed when said piston is displaced from said end wall of said cylinder a maximum distance so that said piston is always positively urged toward said operating element by said first and second springs.

9. The operating device claimed in claim 1 wherein said end wall of said cylinder has a recess (29) for receiving an end of said spring.

10. The operating device claimed in claim 1 wherein said piston and said rack part have a second bore therein extending along said central longitudinal axis of said cylinder, said second bore being shorter than said first bore in said piston and said portion of said rack part, and further comprising a second spring disposed in said second bore.

* * * * *